US007806548B1

(12) United States Patent
Ayala

(10) Patent No.: US 7,806,548 B1
(45) Date of Patent: Oct. 5, 2010

(54) MAGNETIC LIGHT ASSEMBLY ASSOCIATED METHOD

(76) Inventor: Sergio Ayala, 2525 W. Jefferson, Phoenix, AZ (US) 85009

( * ) Notice: Subject to any disclaimer, the term of this patent is extended or adjusted under 35 U.S.C. 154(b) by 477 days.

(21) Appl. No.: 11/906,824

(22) Filed: Oct. 4, 2007

Related U.S. Application Data

(60) Provisional application No. 60/849,187, filed on Oct. 4, 2006.

(51) Int. Cl.
*B25B 23/18* (2006.01)

(52) U.S. Cl. ..... 362/119; 362/109; 362/154; 362/186; 362/287; 362/376; 362/396; 362/427; 211/70.6; 206/350

(58) Field of Classification Search ..... 362/109, 362/119, 154, 183, 186, 190, 191, 287, 376, 362/378, 396, 383, 427; 211/DIG. 1, 70.6; 206/350, 818

See application file for complete search history.

(56) References Cited

U.S. PATENT DOCUMENTS

| | | | | |
|---|---|---|---|---|
| 4,776,766 | A * | 10/1988 | Brent | 417/44.6 |
| 6,360,891 | B1 * | 3/2002 | Rideout | 206/373 |
| 6,811,127 | B1 * | 11/2004 | Shiao | 248/206.5 |
| 2004/0173484 | A1 * | 9/2004 | Bates et al. | 206/349 |
| 2007/0205166 | A1 * | 9/2007 | Meinhardt | 211/70.6 |

* cited by examiner

*Primary Examiner*—Sandra L O'Shea
*Assistant Examiner*—Mary Zettl

(57) ABSTRACT

A multifunctional and portable magnetic light assembly includes a magnetic base section with a unitary and single body provided with a planar bottom surface and a power cable provided with an adaptor removably mated directly thereto. The assembly further includes a power-operated light-emitting source electrically mated to the power cable and directly coupled to the base section in such a manner that the light-emitting source is selectively adjustable along an arcuate path oriented above the base section. The light emitting source further includes an anchor shaft and an illuminable light source. The assembly further includes a mechanism for removably securing a plurality of existing hand tools to the base section.

14 Claims, 2 Drawing Sheets

MAGNETIC LIGHT ASSEMBLY ASSOCIATED METHOD

CROSS REFERENCE TO RELATED APPLICATIONS

This application claims the benefit of U.S. Provisional Application No. 60/849,187, filed Oct. 4, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION TECHNICAL FIELD

This invention relates to light assemblies and, more particularly, to a magnetic light assembly for providing portable light while keeping hand tools engaged with the light assembly.

PRIOR ART

Over the years, many different types of tools have been developed and, nowadays, a tool exists for virtually every possible need. With the advent of power tools, accomplishing many tasks has became much easier and less time consuming. Most power tools (other than battery operated tools) are equipped with a fairly short power cable and extension cords are commonly used to provide extra length. Extension cords are a very convenient means of providing electrical power at locations removed from conventional electrical outlets and are used for a wide variety of applications and tasks.

Another device that is commonly used when performing work with powered or non-powered tools is a utility light, frequently referred to as a work light or drop light. A utility light is comprised of a light bulb, enclosed within a protective, metal cage, and a fairly long power cord which supplies power to the bulb. A hook attached to the metal cage is used to conveniently suspend the light bulb over the work area to provide sufficient light. Although utility lights are very useful devices, a frequently encountered problem is finding a place to hook the light onto that provides adequate light to illuminate the work area. Obviously, it would be advantageous to provide a means to resolve this type of problem.

U.S. Pat. No. 7,121,698 to Johnson discloses a portable hanging light with a portable housing that has a plurality of integral walls defining a plurality of partitions formed therein and an adjustably positionable lens. The light further includes a plurality of light-emitting sources housed within one partition and a plurality of control switches spaced along the housing. A plurality of hook members are secured to selected portions of the housing to assist in maintaining the light at a substantially stable position. One of the hook members is disposed along the axis and another of the hook members is resiliently connected to one of the housing walls along a rear portion thereof. At least one power cord adapter is electrically coupled to the switches for allowing a user to electrically connect the light to alternate ones of the external power sources. Unfortunately, this prior art example does not include a magnet as an alternative stabling mechanism.

U.S. Pat. No. 6,663,265 to Kovacik discloses a double lamp utility light with a vertically split light housing formed in two halves with an elongated upper light portion extending from a hollow lower handle portion. An electrical outlet is provided in a bottom surface of the handle. A pair of switches on the handle control respective ones of a pair of twin bulb fluorescent lamp assemblies. A lens assembly is releasably attached to the housing and can be removed and installed without tools for changing the lamp assemblies. Unfortunately, this prior art example does not provide a mechanism for supporting a device other than manually.

U.S. Pat. No. 5,921,658 to Kovacik discloses a fluorescent utility light that includes an elongated body having a light portion with a detented hook at an upper end and a curved handle portion with an electrical outlet at a lower end adjacent a power cord. A magnet on a clip rotatably engages a groove in the body for attaching the light to a metallic surface. A lens is releasably retained on the body for easy access through an opening to a fluorescent lamp mounted in a socket retained in the body. A plurality of saw tooth ridges formed on an interior of a top wall of the lens directs light from the lamp through the top wall. Unfortunately, this prior art example does not provide hooks as an alternate stability mechanism.

Accordingly, the present invention is disclosed in order to overcome the above noted short comings. The present invention satisfies such a need by providing an assembly that is convenient and easy to use, lightweight yet durable in design, and designed for providing portable light. The multifunctional and portable magnetic light assembly is simple to use, inexpensive, and designed for many years of repeated use.

BRIEF SUMMARY OF THE INVENTION

In view of the foregoing background, it is therefore an object of the present invention to provide an apparatus for providing a portable magnetic light assembly. These and other objects, features, and advantages of the invention are provided by a multifunctional and portable magnetic light assembly.

A multifunctional and portable magnetic light assembly includes a magnetic base section with a unitary and single body effectively provided with a planar bottom surface and a power cable provided with an adaptor removably mated directly thereto. Such an adaptor includes a socket directly matable with the power cord, and first and second conductive clips attached to a distal end of the adaptor such that the power cord can be electrically coupled to positive and negative terminals of an existing battery by mating the first and second conductive clips to the positive and negative terminals respectively.

The assembly further includes a power-operated light-emitting source electrically mated to the power cable and directly coupled to the base section in such a manner that the light-emitting source is selectively adjustable along an arcuate path oriented above the base section. Such a light-emitting source effectively includes a bottom tubular base member monolithically formed with the base section and centrally oriented thereon. Such a base member is equidistantly centered between the magnetic rings and has an arcuate notch formed at a top end thereof.

The light emitting source further includes an anchor shaft with a distal end seated within the notch and further has a proximal end terminating exterior of the notch. A top housing has a generally dome shape directly mated to the proximal end of the anchor shaft. Such a top housing includes a protective mesh screen removably attached to an anterior face of the top housing for advantageously shielding the light source from undesirable foreign debris. Such a mesh screen is freely detachable from the top housing.

The light emitting source further includes an illuminable light source partially nested within the top housing and a pivot lever effectively connected to the anchor shaft and an exterior surface of the base member in such a manner that the pivot lever selectively locks the anchor shaft at alternate positions defined along a travel path extending within the notch so that the top housing is freely adjustable between the alternate positions while the base member remains statically coupled to the base section.

The assembly further includes a mechanism for removably securing a plurality of existing hand tools to the base section while the light-emitting source is adapting along the arcuate path such that the hand tools remain affixed to the base section while the magnetic light assembly is transported between remote locations. Such a removably securing mechanism includes a plurality of annular magnetic rings directly positioned on a top surface of the base section. Each of such magnetic rings is equidistantly and concentrically spaced apart and conveniently seated within a perimeter of the base section. Each of the magnetic rings has continuous and unitary bodies permanently and contiguously seated along the top surface of the base section.

The removably securing mechanism further includes a protective shield directly connected to an outer edge of the base section and extending upwardly therefrom along a partial curvilinear length of the perimeter of the base section. Such a protective shield advantageously has a curvilinear shape with a radius equal to a radius of the base section.

The assembly further includes a hook shaped fastener directly and rotatably engaged with a top edge of the light-emitting source for effectively allowing the magnetic light assembly to be suspended above a ground level.

A method for utilizing a multifunctional and portable magnetic light assembly includes the steps of: providing a magnetic base section with a unitary and single body provided with a planar bottom surface; removably mating an adaptor to a power cable; electrically mating a power-operated light-emitting source to the power cable; selectively adjusting the light-emitting source along an arcuate path oriented above the base section; removably securing a plurality of existing hand tools to the base section while the light-emitting source is adapting along the arcuate path such that the hand tools remain affixed to the base section while the magnetic light assembly is transported between remote locations; and directly and rotatably engaging a hook shaped fastener to a top edge of the light-emitting source for allowing the magnetic light assembly to be suspended above a ground level.

The method further includes the steps of: directly positioning a plurality of annular magnetic rings on a top surface of the base section by equidistantly and concentrically spacing apart and seating each of the magnetic rings within a perimeter of the base section; and directly connecting a protective shield to an outer edge of the base section by extending the protective shield upwardly along a partial curvilinear length of the perimeter of the base section.

The method further includes the steps of: providing a bottom tubular base member monolithically formed with the base section and centrally oriented thereon such that the base member is equidistantly centered between the magnetic rings; seating a distal end of an anchor shaft within a notch of the base member by terminating a proximal end of the base member exterior of the notch; directly mating a generally dome shaped top housing to the proximal end of the anchor shaft; partially nesting an illuminable light source within the top housing; connecting a pivot lever to the anchor shaft and an exterior surface of the base member; selectively locking the anchor shaft at alternate positions defined along a travel path extending within the notch by rotating the pivot lever along clockwise and counter clockwise directions respectively; and freely adjusting the top housing between the alternate positions while the base member remains statically coupled to the base section.

The method further includes the step of: removably attaching a protective mesh screen to an anterior face of the top housing and thereby shielding the light source from undesirable foreign debris.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
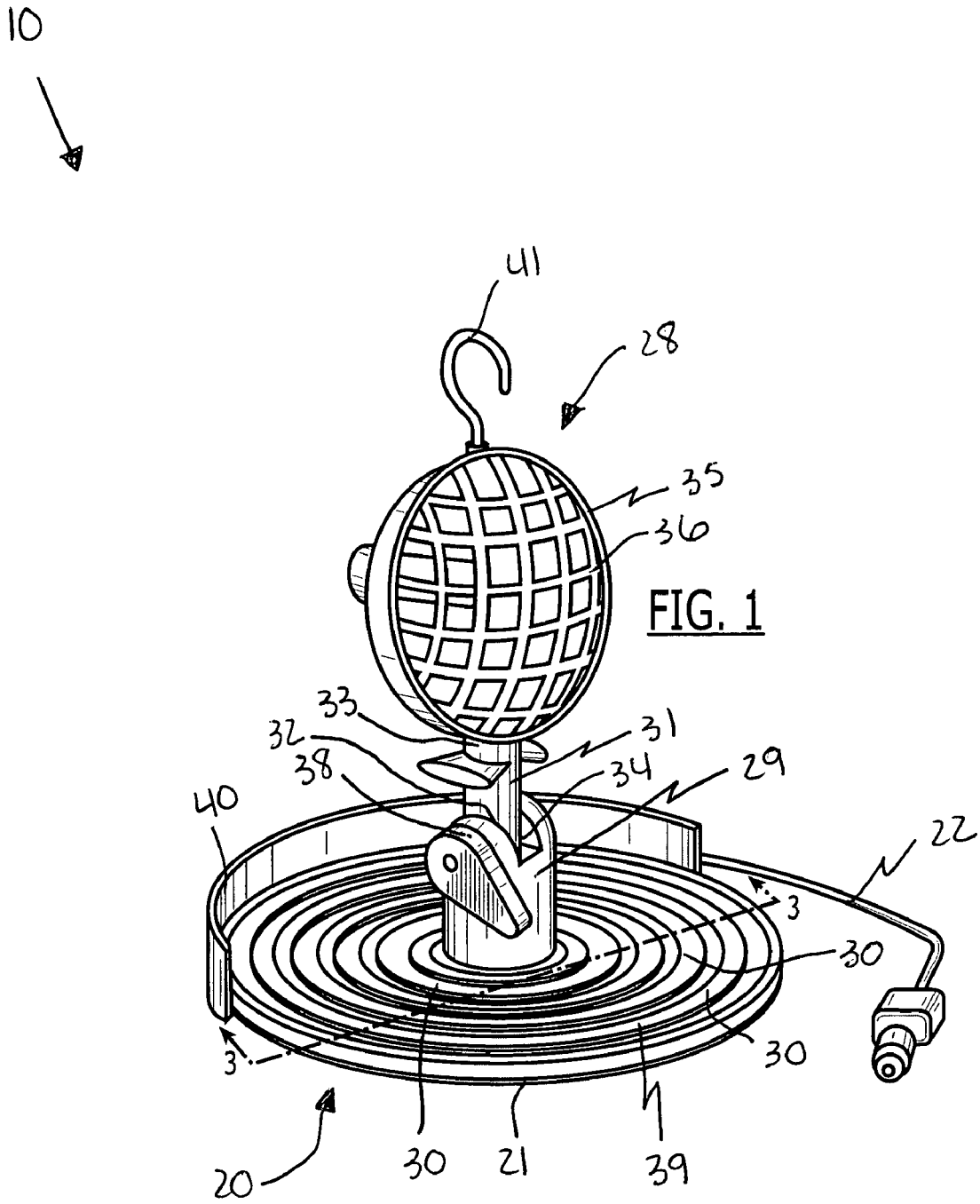
FIG. 1 is a perspective view showing a multifunctional and portable magnetic light assembly, in accordance with the present invention.
Figure 2:
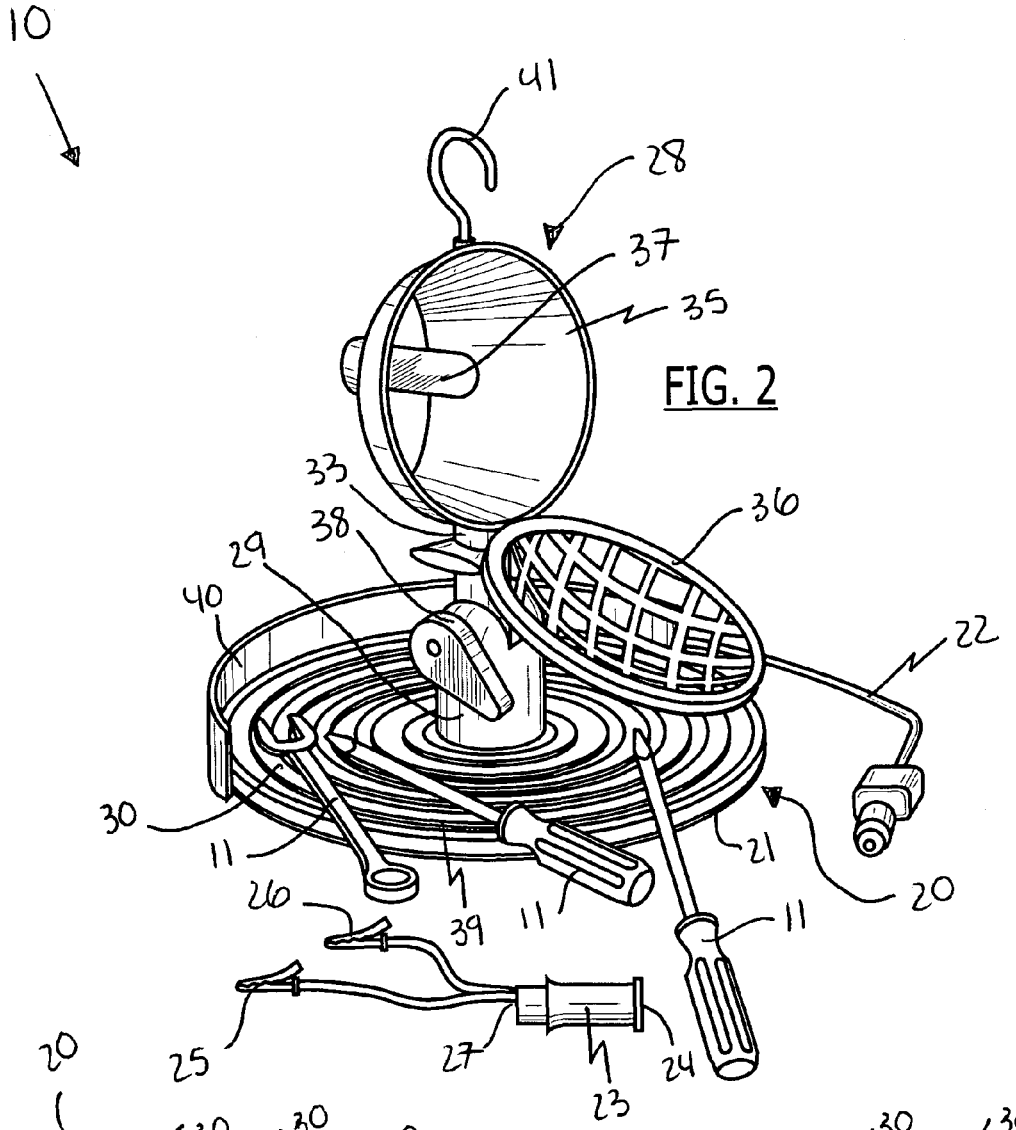
FIG. 2 is a perspective view showing a multifunctional and portable magnetic light assembly, with the mesh screen removed, in accordance with the present invention.
Figure 3:
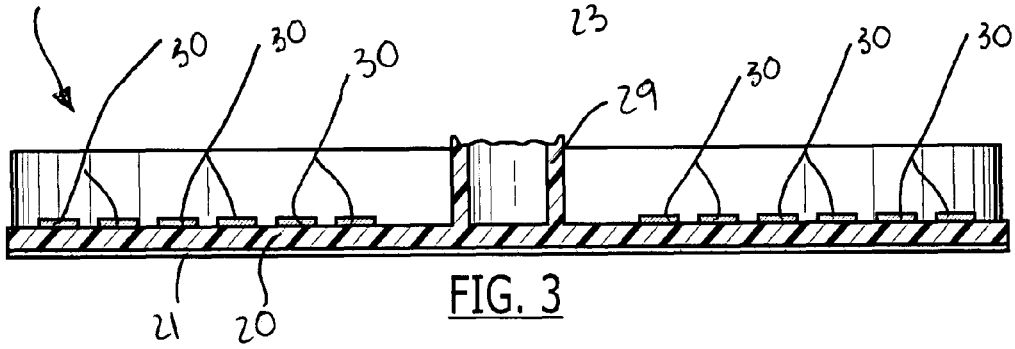
FIG. 3 is a cross sectional view of the base section, taken along line 3-3, as seen in FIG. 1.

The assembly of this invention is referred to generally in FIGS. 1-3 by the reference numeral 10 and is intended to protect a multifunctional and portable magnetic light assembly. It should be understood that the assembly 10 may be used to provide light in many different setting and should not be limited to providing light in only those settings mentioned herein.

Referring initially to FIGS. 1, 2 and 3, a multifunctional and portable magnetic light assembly 10 includes a magnetic base section with a unitary and single body 20 provided with a planar bottom surface 21 and a power cable 22 provided with an adaptor 23 removably mated directly thereto, without the use of intervening elements. Such an adaptor 23 includes a socket 24 directly matable, without the use of intervening elements, with the power cord 22, and first and second conductive clips 25, 26 attached to a distal end 27 of the adaptor 23 which is important such that the power cord 22 can be electrically coupled to positive and negative terminals of an existing battery by mating the first and second conductive clips 25, 26 to the positive and negative terminals respectively. The adaptor 23 is provided for those occasions when a standard power outlet is not available. The adaptor 23 may then be used to receive energy from a car battery.

Referring to FIGS. 1 and 2, the assembly 10 further includes a power-operated light-emitting source 28 electrically mated to the power cable 22 and directly coupled, without the use of intervening elements, to the base section 20 in such a manner that the light-emitting source 28 is selectively adjustable along an arcuate path oriented above the base section 20. Such a light-emitting source 28 includes a bottom tubular base member 29 monolithically formed with the base section 20 and centrally oriented thereon. Such a base member 29 is equidistantly centered between magnetic rings 30 and has an arcuate notch formed at a top end thereof. The light-emitting source 28 may remain connected to the base section 20 or alternatively removed from the base section 20 for easier portability.

Referring again to FIGS. 1 and 2, the light emitting source 28 further includes an anchor shaft 31 with a distal end 32 seated within the notch 34 and further has a proximal end 33 terminating exterior of the notch 34. A top housing 35 has a generally dome shape directly mated, without the use of intervening elements, to the proximal end 33 of the anchor shaft 31. Such a top housing 35 includes a protective, mesh screen 36 removably attached to an anterior face of the top housing 35 for shielding the light source from undesirable foreign debris. Such a mesh screen 36 is freely detachable from the top housing 35. The protective mesh screen 36 may be removed in order to facilitate the replacement of an illuminable light source 37.

Referring again to FIGS. 1 and 2, the light emitting source 28 further includes an illuminable light source 37 partially nested within the top housing 35 and a pivot lever 38 connected to the anchor shaft 31 and an exterior surface of the base member 29 in such a manner that the pivot lever 38 selectively locks the anchor shaft 31 at alternate positions defined along a travel path extending within the notch 34 which is vital so that the top housing 35 is freely adjustable between the alternate positions while the base member 29 remains statically coupled to the base section 20. The pivot lever 38 enables a user to adjust the anchor shaft 31 to provide the best light.

Referring to FIGS. 1, 2 and 3, the assembly 10 further includes a mechanism 39 for removably securing a plurality of existing hand tools 11 to the base section 20 while the light-emitting source 37 is adapting along the arcuate path which is essential such that the hand tools 11 remain affixed to the base section 20 while the magnetic light assembly 10 is transported between remote locations. Such a removably securing mechanism 39 includes a plurality of annular magnetic rings 30 directly positioned, without the use of intervening elements, on a top surface of the base section 20. Each of such magnetic rings 30 is equidistantly and concentrically spaced apart and seated within a perimeter of the base section 20. Each of the magnetic rings 30 has continuous and unitary bodies permanently and contiguously seated along the top surface of the base section 20. The removably securing mechanism 39 is provided for storing various hand tools 11.

Referring to FIGS. 1 and 2, the removably securing mechanism 39 further includes a protective shield 40 directly connected, without the use of intervening elements, to an outer edge of the base section 20 and extending upwardly therefrom along a partial curvilinear length of the perimeter of the base section 20. Such a protective shield 40 has a curvilinear shape with a radius equal to a radius of the base section 20.

Referring again to FIGS. 1 and 2, the assembly 10 further includes a hook shaped fastener 41 directly and rotatably engaged, without the use of intervening elements, with a top edge of the light-emitting source 37 for allowing the magnetic light assembly 10 to be suspended above a ground level. The hook shaped fastener 41 provides a user a method for suspending the assembly 10 over a given work area.

The assembly includes a light assembly that has a light emitting source installed and enclosed within a protective metal cage, a flexible arm, a power cable, and a circular magnetic tray. Such a protective metal cage that encloses the light assembly and light emitting source includes a hook that is directly attached to, without the use of intervening elements, and extends outward from the top of the cage. The hook is conveniently used to suspend the device over a work area, if a suitable place can be found. One side of the cage is hinged, which is crucial for easily removing and replacing the light emitting source, when required. The bottom end of the protective metal cage is attached to a flexible arm which can advantageously be maneuvered to various positions and the ringed, metal segments conveniently make it possible for the flex arm to maintain any position it is adjusted to.

The metal cage is approximately 12 inches in height and 6 inches in circumference. The flexible arm has power cables extending outward from its lower end, and is about 6 feet in length. The flexible arm and light can be used independently or can be clamped onto the magnetic tray and secured by use of a retaining, butterfly nut. Such a magnetic tray is securely attached to metal parts of a car or any other magnetically conducive surface. The two power cables that extend outward from the flex arm are color coded (red and black) and the ends are terminated by sturdy alligator clips. The red cable is attached to the positive battery terminal and the black cable is connected to the negative battery terminal to effectively supply an operating power to the light.

The present invention, as claimed, provides the unexpected and unpredictable benefit of a portable light that provides several hand-free options. The hook may be used to suspend the assembly over a given work area. In addition, the magnetic bottom surface of the base section allows the assembly to be supported by any magnetic surface. The magnetic rings provide a storage area for hand tools during transportation or storage of the assembly. Such benefits overcome the prior art shortcomings.

The present invention provides an assembly that is convenient and easy to use, is versatile in its applications, is durable yet lightweight in design, and provides users with a convenient means of attaching a utility light at various locations. The versatile nature of the assembly allows a user to position the light in such a manner that it provides optimal illumination in every instance. The battery adapter also allows the device to be used at remote locations where a conventional power outlet may not be readily available.

In use, a method for utilizing a multifunctional and portable magnetic light assembly 10 includes the steps of: providing a magnetic base section 20 with a unitary and single body provided with a planar bottom surface 21; removably mating an adaptor 23 to a power cable 22; electrically mating a power-operated light-emitting source 28 to the power cable 22; selectively adjusting the light-emitting source 28 along an arcuate path oriented above the base section 20; removably securing a plurality of existing hand tools 11 to the base section 20 while the light-emitting source 28 is adapting along the arcuate path such that the hand tools 11 remain affixed to the base section 20 while the magnetic light assembly 10 is transported between remote locations; and directly and rotatably engaging a hook 41 shaped fastener to a top edge of the light-emitting source 28 for allowing the magnetic light assembly 10 to be suspended above a ground level.

In use, the method further includes the steps of: directly positioning a plurality of annular magnetic rings 30 on a top surface of the base section 20 by equidistantly and concentrically spacing apart and seating each of the magnetic rings 30 within a perimeter of the base section 20; and directly connecting a protective shield 40 to an outer edge of the base section 20 by extending the protective shield 40 upwardly along a partial curvilinear length of the perimeter of the base section 20.

In use, the method further includes the steps of: providing a bottom tubular base member 29 monolithically formed with the base section 20 and centrally oriented thereon such that the base member 29 is equidistantly centered between the magnetic rings 30; seating a distal end 32 of an anchor shaft 31 within a notch 34 of the base member 29 by terminating a proximal end 33 of the base member 29 exterior of the notch 34; directly mating a generally dome shaped top housing 35 to the proximal end 33 of the anchor shaft 31; partially nesting an illuminable light source 37 within the top housing 35; connecting a pivot lever 38 to the anchor shaft 31 and an exterior surface of the base member 29; selectively locking the anchor shaft 29 at alternate positions defined along a travel path extending within the notch 34 by rotating the pivot lever 38 along clockwise and counter clockwise directions respectively; and freely adjusting the top housing 35 between the alternate positions while the base member 29 remains statically coupled to the base section.

In use, the method further includes the step of: removably attaching a protective mesh screen 36 to an anterior face of the top housing 35 and thereby shielding the light source 37 from undesirable foreign debris.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A multifunctional and portable magnetic light assembly comprising:

a base section having a unitary and single body provided with a planar bottom surface;

a power cable provided with an adaptor removably mated directly thereto;

a light-emitting source electrically mated to said power cable and directly coupled to said base section in such a manner that said light-emitting source is selectively adjustable along an arcuate path oriented above said base section;

means for removably securing a plurality of existing hand tools to said base section while said light-emitting source is adapting along said arcuate path such that the hand tools remain affixed to said base section while said magnetic light assembly is transported between remote locations;

wherein said removably securing means comprises:

a plurality of annular magnetic rings directly positioned on a top surface of said base section, each of said magnetic rings being equidistantly and concentrically spaced apart and seated within a perimeter of said base section; and a protective shield directly connected to an outer edge of said base section and extending upwardly therefrom along a partial curvilinear length of said perimeter of said base section;

wherein said protective shield has a curvilinear shape having a radius equal to a radius of said base section.

2. The magnetic light assembly of claim 1, wherein each of said magnetic rings have continuous and unitary bodies permanently and contiguously seated along said top surface of said base section.

3. The magnetic light assembly of claim 1, wherein said light-emitting source comprises:

a bottom tubular base member monolithically formed with said base section and centrally oriented thereon, said base member being equidistantly centered between said magnetic rings, said base member having an arcuate notch formed at a top end thereof;

an anchor shaft having a distal end seated within said notch and further having a proximal end terminating exterior of said notch;

a top housing having a generally dome shape directly mated to said proximal end of said anchor shaft;

an illuminable light source partially nested within said top housing; and a pivot lever connected to said anchor shaft and an exterior surface of said base member in such a manner that said pivot lever selectively locks said anchor shaft at alternate positions defined along a travel path extending within said notch so that said top housing is freely adjustable between the alternate positions while said base member remains statically coupled to said base section.

4. The magnetic light assembly of claim 3, wherein said top housing comprises:

a protective mesh screen removably attached to an anterior face of said top housing for shielding said light source from undesirable foreign debris, said mesh screen being freely detachable from said top housing.

5. The magnetic light assembly of claim 1, wherein said adaptor comprises:

a socket directly matable with said power cord; and first and second conductive clips attached to a distal end of said adaptor such that said power cord can be electrically coupled to positive and negative terminals of an existing battery by mating said first and second conductive clips to the positive and negative terminals respectively.

6. A multifunctional and portable magnetic light assembly comprising:

a magnetic base section having a unitary and single body provided with a planar bottom surface;

a power cable provided with an adaptor removably mated directly thereto;

a power-operated light-emitting source electrically mated to said power cable and directly coupled to said base section in such a manner that said light-emitting source is selectively adjustable along an arcuate path oriented above said base section;

means for removably securing a plurality of existing hand tools to said base section while said light-emitting source is adapting along said arcuate path such that the hand tools remain affixed to said base section while said magnetic light assembly is transported between remote locations;

a hook shaped fastener directly and rotatably engaged with a top edge of said light-emitting source for allowing said magnetic light assembly to be suspended above a ground level;

wherein said removably securing means comprises:

a plurality of annular magnetic rings directly positioned on a top surface of said base section, each of said magnetic rings being equidistantly and concentrically spaced apart and seated within a perimeter of said base section; and a protective shield directly connected to an outer edge of said base section and extending upwardly therefrom along a partial curvilinear length of said perimeter of said base section;

wherein said protective shield has a curvilinear shape having a radius equal to a radius of said base section.

7. The magnetic light assembly of claim 6, wherein each of said magnetic rings have continuous and unitary bodies permanently and contiguously seated along said top surface of said base section.

8. The magnetic light assembly of claim 6, wherein said light-emitting source comprises:

a bottom tubular base member monolithically formed with said base section and centrally oriented thereon, said base member being equidistantly centered between said magnetic rings, said base member having an arcuate notch formed at a top end thereof;

an anchor shaft having a distal end seated within said notch and further having a proximal end terminating exterior of said notch;

a top housing having a generally dome shape directly mated to said proximal end of said anchor shaft;

an illuminable light source partially nested within said top housing; and a pivot lever connected to said anchor shaft and an exterior surface of said base member in such a manner that said pivot lever selectively locks said anchor shaft at alternate positions defined along a travel path extending within said notch so that said top housing is freely adjustable between the alternate positions while said base member remains statically coupled to said base section.

9. The magnetic light assembly of claim 8, wherein said top housing comprises:

a protective mesh screen removably attached to an anterior face of said top housing for shielding said light source from undesirable foreign debris, said mesh screen being freely detachable from said top housing.

10. The magnetic light assembly of claim 6, wherein said adaptor comprises:

a socket directly matable with said power cord; and first and second conductive clips attached to a distal end of said adaptor such that said power cord can be electrically coupled to positive and negative terminals of an existing battery by mating said first and second conductive clips to the positive and negative terminals respectively.

11. A method for utilizing a multifunctional and portable magnetic light assembly, said method comprising the steps of:

a. providing a magnetic base section having a unitary and single body provided with a planar bottom surface;

b. removably mating an adaptor to a power cable;

c. electrically mating a power-operated light-emitting source to said power cable;

d. selectively adjusting said light-emitting source along an arcuate path oriented above said base section;

e. removably securing a plurality of existing hand tools to said base section while said light-emitting source is adapting along said arcuate path such that the hand tools remain affixed to said base section while said magnetic light assembly is transported between remote locations; and f. directly and rotatably engaging a hook shaped fastener to a top edge of said light-emitting source for allowing said magnetic light assembly to be suspended above a ground level;

wherein step d. comprises the steps of:

directly positioning a plurality of annular magnetic rings on a top surface of said base section by equidistantly and concentrically spacing apart and seating each of said magnetic rings within a perimeter of said base section; and directly connecting a protective shield to an outer edge of said base section by extending said protective shield upwardly along a partial curvilinear length of said perimeter of said base section.

12. The method of claim 11, wherein step c. comprises the steps of:

providing a bottom tubular base member monolithically formed with said base section and centrally oriented thereon such that said base member is equidistantly centered between said magnetic rings;

seating a distal end of an anchor shaft within a notch of said base member by terminating a proximal end of said base member exterior of said notch;

directly mating a generally dome shaped top housing to said proximal end of said anchor shaft;

partially nesting an illuminable light source within said top housing; and connecting a pivot lever to said anchor shaft and an exterior surface of said base member;

selectively locking said anchor shaft at alternate positions defined along a travel path extending within said notch by rotating said pivot lever along clockwise and counter clockwise directions respectively; and freely adjusting said top housing between the alternate positions while said base member remains statically coupled to said base section.

13. The method of claim 12, further comprising the step of:

removably attaching a protective mesh screen to an anterior face of said top housing and thereby shielding said light source from undesirable foreign debris.

14. The method of claim 13, wherein said adaptor comprises:

a socket directly matable with said power cord; and first and second conductive clips attached to a distal end of said adaptor such that said power cord can be electrically coupled to positive and negative terminals of an existing battery by mating said first and second conductive clips to the positive and negative terminals respectively.

* * * * *